United States Patent [19]

Kuroda et al.

[11] 4,159,733

[45] Jul. 3, 1979

[54] MOLDING MACHINE

[75] Inventors: Masanobu Kuroda; Kazuo Noda, both of Kumagaya; Shinichi Kobayashi, Fukaya, all of Japan

[73] Assignee: Hitachi Metals, Ltd., Japan

[21] Appl. No.: 877,618

[22] Filed: Feb. 14, 1978

[51] Int. Cl.[2] ..... B22C 15/08

[52] U.S. Cl. ..... 164/211; 164/173; 164/193

[58] Field of Search ..... 164/169, 172, 173, 192, 164/193, 207, 210, 211, 212, 37

[56] References Cited

U.S. PATENT DOCUMENTS

| | | | |
|---|---|---|---|
| 2,782,471 | 2/1957 | Mathisen | 164/192 |
| 3,556,196 | 1/1971 | Buhler | 164/160 |
| 3,589,433 | 6/1971 | Hedberg | 164/207 |

FOREIGN PATENT DOCUMENTS

| | | | |
|---|---|---|---|
| 44-17125 | 7/1969 | Japan | 164/207 |
| 457531 | 3/1975 | U.S.S.R. | 164/207 |

*Primary Examiner*—Othell M. Simpson
*Assistant Examiner*—K. Y. Lin
*Attorney, Agent, or Firm*—Craig and Antonelli

[57] ABSTRACT

A molding machine has a molding table disposed in a lower machine section, squeeze cylinders disposed at a level above the molding table, squeeze plates movable by the squeeze cylinders in vertical direction into and out of squeezing engagement with a sand mold around a pattern on the molding table, and a rapping device disposed in an upper machine section. An open-topped hollow tubular member is operatively connected to the squeeze cylinders and disposed in telescopic relationship with the bottom of a sand-feeding chute. The squeeze plates are pivotally mounted on the tubular member and pivotally moved by a cylinder to open and close the bottom of the tubular member. The squeeze plates when in the closed position and the tubular member cooperate together to define a sand retaining space and to form a squeeze head which is operable by the squeeze cylinders.

7 Claims, 9 Drawing Figures

MOLDING MACHINE

BACKGROUND OF THE INVENTION

1. Field of the Invention

The present invention relates to a molding machine having squeeze device and rapping device both mounted on an upper part of the machine.

2. Description of the Prior Art

In one type of the prior art molding machines, the movable elements of the machine, such as squeeze device, rapping device and so on, were disposed below a molding table. When sand was introduced into a molding flask placed on the molding table, a part of the sand was apt to be scattered and to fall onto and into the movable machine parts to cause machine troubles and decrease the accuracy of the machine operation. Particularly, the mold forming performance or capability of a molding machine depends greatly upon the accuracy of the rapping device. If the rapping device of a machine is not accurately operative, a pattern cannot easily be removed from a mold formed and a part of the sand forming the mold drops from the mold with a resultant disadvantageous formation of fins on a cast metal. Because of the problem discussed, the rate of the actual operation of the machine and the yield rate of products are greatly decreased.

A deposit is formed on the lower part of a molding machine by the sand which is scattered and falls during a molding operation. If the deposit of sand is not fully swept away or if the machine is not designed to prevent the formation of a deposit of scattered sand, it is possible that the lower part of the machine is embedded in the deposit. Thus, the effect of dropped and scattered sand to a molding machine is not negligible at all.

The normal type of the prior art molding machine was equipped with a squeeze head which was either rotatable in a horizontal plane or generally horizontally movable fore and aft into and out of vertical alignment with a molding flask on a molding table. Because a sand hopper had to be disposed so as not to interfere with the movement of the squeeze head, the bottom end of the hopper was upwardly spaced a substantial distance from the molding flask. It was for this reason that sand falled and scattered onto the lower part of a machine either directly from the hopper or from the molding flask during sand charging operation. It was impossible to completely eliminate this problem. It was also impossible to uniformly supply a molding flask with the minimum and necessary amount of sand. Despite the problems and disadvantages discussed above, many prior art molding machines were each designed such that the movable machine parts, such as squeeze device, rapping device and so on, were disposed below the molding table.

In an attempt to solve the problems and eliminate the disadvantages, it was proposed to dispose in an upper machine section the movable machine parts such as squeeze device, rapping device and so on and to operatively connect the squeeze device with a sand hopper so that the squeeze device and the hopper were alternately reciprocally moved. The molding machine according to the proposal, however, had a shortcoming that the squeeze device and the hopper were heavy-weighted (amounting to several tons in the case of the molding of large-sized molds) had to be reciprocally moved in each molding operation. In order that the machine might be used for a high speed molding, the machine had to be equipped with shock absorbing means and powerful driving means for the heavy-weighted machine components, which inevitably complicated the machine structure and increased the cost of manufacture of the machine. The molding machine of the described type had a further problem that it was difficult to mount a sand-heaping flask which was the conventional means to uniformly charge a molding flask with sand.

Another type of molding machine was proposed in which sand-charging chutes were disposed on the opposite sides of the machine so as not to interfere with a sand hopper and a squeeze head. This type of molding machine, however, necessitated a complicated structure and arrangement to eliminate or avoid interference between the squeeze head and the sand chutes during a squeezing operation.

Moreover, the feeding of sand into a molding flask was carried out generally in such a manner that a batch of sand substantially corresponding to a flask of sand in squeezed condition was fed and held in a sand hopper during the formation of a preceding mold to shorten the time required for each molding operation. After the preceding mold was formed and removed from the machine, an empty molding flask was fed into the machine and the batch of sand was then released and introduced into the empty flask by opening a sand gate disposed above the flask. The gate was formed of a single gate plate or a pair of gate plates or a plurality of rotatable gate plates. In any case, a squeeze head had to be moved to a position above the sand-charged molding flask to perform a squeezing operation. Thus, the molding machine was inevitably large-sized and complicated and, in addition, involved a loss time in each molding operation due to the time required for the reciprocal movement of the squeeze head into and out of vertical alignment with a sand-charged molding flask.

In an attempt to solve this problem, a further type of molding machine was proposed in which a squeeze head was divided into two sections which were laterally reciprocally movable relative to other between separated and united or combined positions so that the time required for one reciprocal movement of the two squeeze head sections was reduced substantially to one half the time required by one reciprocal movement of the single-headed squeeze head. With the further type of molding machine, when the two squeeze head sections were in the separated-apart position, sand was fed into an empty molding flask through the space defined between the separated squeeze head sections. The squeeze head sections were then moved into united or combined position and a molding table was then lifted to upwardly urge the sand in the flask against the united squeeze head sections to squeeze the sand. This type of molding machine, however, necessitated a mechanism for the reciprocal movement of the two squeeze head sections as well as a mechanism for the opening and closing of the bottom of sand hopper. In addition, it was impossible with this type of molding machine to dispose the movable parts of the machine, such as squeeze cylinder, rapping device and so on, in the upper part of the machine because of the structural design of the machine.

SUMMARY OF THE INVENTION

It is an object of the present invention to provide an improved molding machine which eliminates the difficulties and problems discussed above.

It is another object of the present invention to provide an improved molding machine of the type that has its movable parts, such as squeeze device and rapping device, disposed in an upper section of the machine to minimize the adverse effect of scattered sand to the machine and in which, by a relatively simple structural change to the prior art molding machine structure, the sand falling and scattering during a sand charging operation are substantially eliminated and sand is fed into a molding flask substantially uniformly and flatly.

According to the present invention, there is provided an improved molding machine of the type that includes upper and lower sections, a molding table disposed in the lower machine section and adapted to support thereon at least one pattern around which sand is formed into a mold, a squeeze means including at least one fluid-actuated squeeze cylinder disposed at a level above the molding table and squeeze plate means operatively associated with the squeeze cylinder so that the squeeze plate means is substantially vertically moved into and out of squeezing engagement with a sand mold around the pattern, and rapping means disposed in the upper machine section, the improvement which comprises an open-topped hollow tubular member connected to the squeeze cylinder; the squeeze plate means being mounted on the tubular member for pivotal movement between open and closed positions to open and close the bottom of the tubular member; the tubular member and the squeeze plate means when in closed position cooperating together to define a sand retaining space and to form a squeeze head operable by the squeeze cylinder.

The above and other objects, features and advantages of the present invention will be made apparent by the following description with reference to the accompanying drawings.

DESCRIPTION OF PREFERRED EMBODIMENTS

Figure 1:
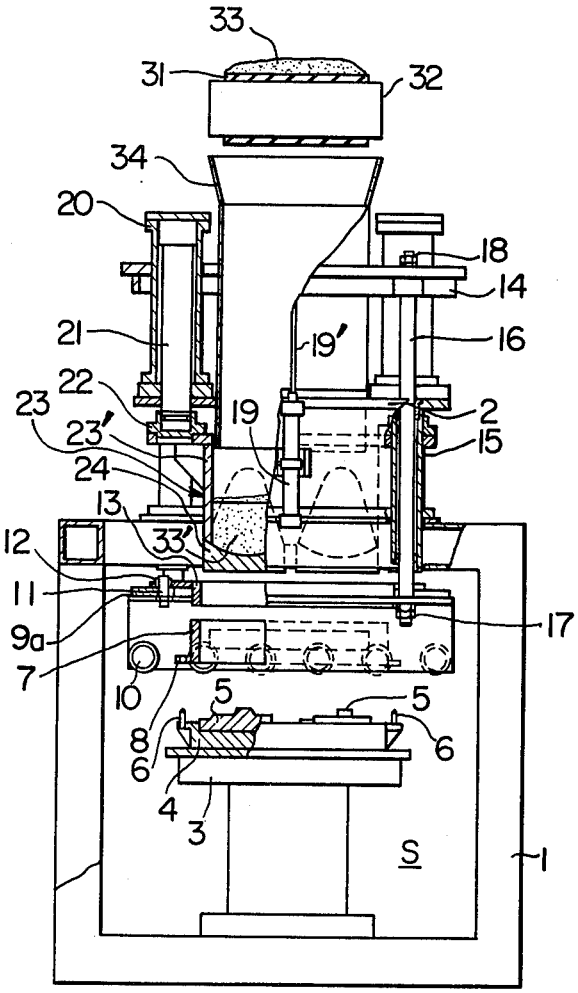
FIG. 1 is a partly sectional front elevation of an embodiment of the molding machine according to the present invention.
Figure 2:
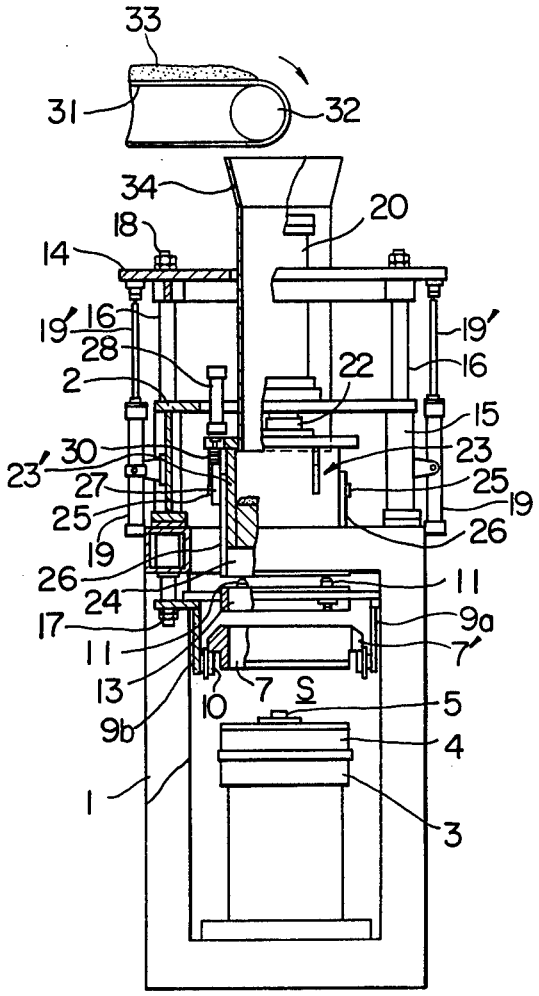
FIG. 2 is a partly sectional side elevation of the molding machine shown in FIG. 1.

Referring first to FIGS. 1 and 2, there is shown a molding machine including lower and upper machine frame sections 1 and 2 rigidly secured together to form a unitary machine frame. The lower machine frame section 1 includes four upstanding frame members and substantially horizontal bottom and top which are connected together to form a generally box-like frame work defining therein a space S in which a molding table 3 is disposed and rigidly mounted on the bottom. A jolt device (not shown) may be installed in the molding table 3 if required. The molding table 3 supports thereon a pattern plate 4 on which a pair of patterns 5 are mounted. The pattern plate 4 is provided with guide pins 6 secured thereto adjacent to the opposite sides of the plate for the purpose of guiding and positioning a molding flask 7 relative to the pattern plate 4 and thus to the patterns 5 when a molding operation is performed. The molding flask 7 is supported at its lugs or flanges 7' by substantially horizontal rows of rollers 10 which are rotatably mounted on a pair of horizontally spaced parallel roller frames 9*a* and 9*b* which are substantially vertically movable together within the space S. A pair of guide pins 11 are secured to the top of the roller frames 9*a* and 9*b*. A sand-heaping flask 13 is supported on the top of the roller frames 9*a* and 9*b* for relative vertical movement with respect to the roller frames. The vertical movement is guided by the guide pins 11 which are in slidable engagement with guide holes 12 formed in flanges extending outwardly from the opposite sides of the flask 13.

The top of the lower machine frame section 1 defines therein a central opening (not shown). The upper machine frame section 2 is substantially quadrilateral in top plan view (not shown) and also defines therein a central opening vertically aligned with the opening in the top of the lower machine frame section 1. Four horizontally spaced and parallel guide bushings 15 extend vertically and have upper ends secured to the upper machine frame section 2. The lower end portions of the guide sleeves 15 extend through the top of the lower machine frame section 1 around the central opening therein, as will be seen in FIG. 1. The upper machine frame section 2 is formed with guide holes in vertical alignment with the guide sleeves 15, respectively. Two pairs of guide rods 16 extend slidably through respective guide sleeves 15 and have lower portions extending into the space S and secured at the lower ends to the roller frames 9*a* and 9*b* by means of nuts 17 so that the roller frames 9*a* and 9*b* are supported from the guide rods 16. It is important that the rollers 10 are arranged such that the tops of the rollers define a horizontal plane on which a molding flask rests, to thereby facilitate reliable rapping operation and assure high quality of molds and thus of articles cast thereby. The guide rods 16 have upper portions slidably extending through the guide holes in the upper machine frame section 2 and have the upper ends secured by nuts 18 to a synchronizing or balancing frame 14 which is generally quadrilateral and defines therein a central opening (not shown).

A pair of fluid-pressure actuated rapping cylinders 19 are mounted on the opposite sides of the upper machine frame section 2, as best shown in FIG. 2, and have piston rods 19' connected to the balancing frame 14. It will be appreciated that, when the rapping cylinders 19 are actuated by a fluid pressure, such as air pressure, a rapping means consisting of the balancing frame 14, guide rods 16, roller frames 9a and 9b and rollers 10 can be vertically moved together with a molding flask 7 mounted on the roller frames for the guiding and positioning of the flask and for the rapping operation.

Figure 6:
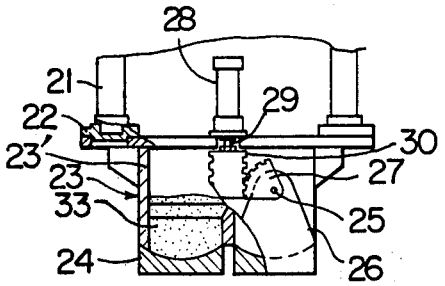
FIG. 6 is a partly sectional fragmentary front view of the molding machine showing a mechanism for actuating squeezing plates between open and closed positions.

A sand chute 34 is mounted on the upper machine frame section 2 and vertically extends through the central openings defined in the balancing frame 14 and in the upper machine frame section 2. A pair of squeeze cylinders 20 are also mounted on the upper machine frame section 2 at the opposite sides of the sand chute 34. The squeeze cylinders 20 extend vertically and have piston rods 21 secured at the bottom ends to connectors 22 which in turn are secured to the top of a squeeze head 23 which includes a tubular hollow member 23' arranged in telescopic relationship with the lower end portion of the sand chute 34. A pair of squeeze plates 24 are respectively secured to arm plates 26 which are pivotally mounted by pins 25 on the opposite side walls of the tubular member 23' in the lower part thereof so that the squeeze plates 24 are rotatable with the arm plates 26 about the axes of the pins 25, respectively. It will be best seen in FIGS. 6, 7 and 8 that the upper or inner surface of each of the squeeze plates 24 and the mating bottom edge of the tubular member 23' are of arcuate profiles having a common center substantially coincident with the axis of one of the pins 25.

Figure 7:
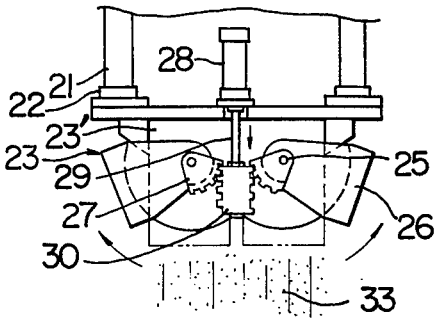
FIG. 7 illustrates the squeezing plates in fully open positions.

It will be best seen in FIG. 7 that pinions 27 secured respectively to the arm plates 26 and rotatable about the axes of the pins 25 are in meshing engagement with teeth formed along opposite edges of a common rack 30 connected to the free end of a piston rod 29 of a cylinder 28 which is mounted on the upper machine frame section 2. The rack 30 is vertically movable by the cylinder 28 to rotate the two pinions 27 in opposite directions so that the two sets of the arm plates 26 and the squeeze plates 24 are rotated in the opposite directions about the axes of the pins 25 to open and close the bottom end of the tubular member 23' of the squeeze head 23. A conveyor belt 31 extends around a drum 32 disposed above the chute 34 to feed sand 33 into the chute. The sand thus fed falls through the cute 34 into the squeeze head 23 which, when closed by the squeeze plates 24, also acts as a sand hopper which receives and holds a batch of sand substantially equal to a flask of sand necessary and sufficient to form a mold.

Figure 3:
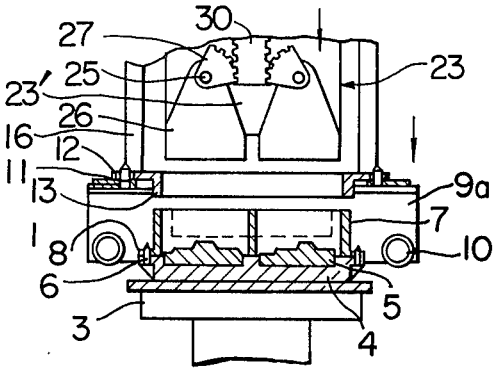
FIG. 3 is a partly sectional fragmentary front view of the molding machine showing a molding flask placed in position on a pattern plate of the machine.
Figure 4:
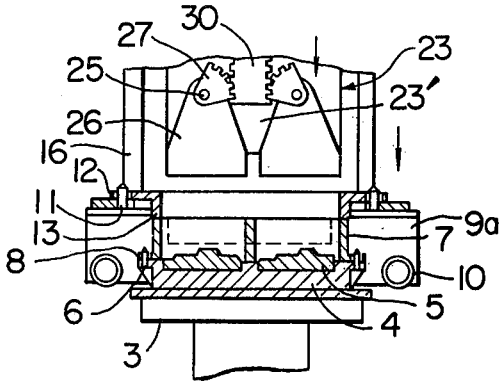
FIG. 4 is a view generally similar to FIG. 3 but illustrates a sand-heaping flask in contact with the molding flask.
Figure 5:
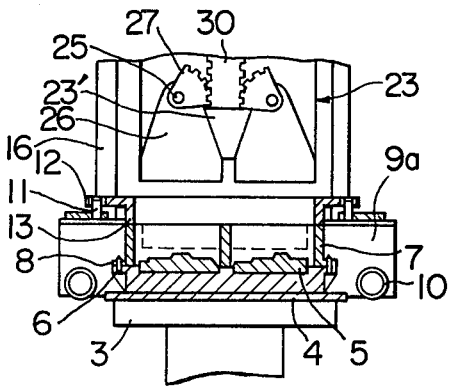
FIG. 5 is a view generally similar to FIG. 3 but illustrates the molding flask, the pattern plate, the sand-heaping flask and a flask supporting roller frame when a flask guiding and positioning operation is finished.

The operation of the molding machine will now be described. FIGS. 1 and 2 show the machine with a batch of sand 33' fed into the squeeze head 23 and with an empty molding flask 7 placed in position on the rollers 10. From this position of the molding machine, a flask guiding operation will be started. The piston rods 19' of the rapping cylinders 19 simultaneously start downward movements to lower the balancing frame 14, the guide rods 16, the roller frames 9a and 9b and the rollers 10 so that the empty flask 7 is vertically lowered by gravity. In the final stage of the downward movement of the flask 7, the flask is guided by sliding engagement with bushings 8 therein with the guide pins 6 on the pattern plate 4 until the flask 7 takes a set position in which the flask is correctly placed in a predetermined position and in which the bottom face of the flask is in face-to-face engagement with the top face of the pattern plate 4, as shown in FIG. 3. At this time, the piston rods 21 of the squeeze cylinders 20 simultaneously start downward movements. The downward movements of the piston rods 19' of the rapping cylinders 19 are continued to lower the roller frames 9a and 9b and the rollers 10 thereon until the bottom surface of the sand-heaping flask 13 is lowered by gravity into face-to-face engagement with the top surface of the molding flask 7, as shown in FIG. 4. The rapping cylinder piston rods 19' are further moved downwardly to a position in which the top surfaces of the roller frames 9a and 9b are moved downwardly away from the sand-heaping flask 13, as shown in FIG. 5, and the sand-heaping flask 13 is now laterally supported and guided simply by engagement between the guide holes 12 and the pins 11. The flask-guiding and positioning operation is now finished. The squeeze cylinders 20 may preferably be actuated to lower the squeeze head 23 during the flask-guiding and positioning operation to such an extent where the squeeze plates 24 can be freely rotated without interference with the sand-heaping flask 13 to release the sand into an assembly of the flasks 7 and 13. The operation of the squeeze cylinders 20 in this fashion will reduce loss time and increase the productivity of the machine.

When the squeeze head 23 has been lowered to a predetermined position above the sand-heaping flask 13 and stopped at this position, the cylinder 28 is actuated to lower the piston rod 29 thereof and the associated rack 30 to rotate the pinions 27 together with the arm plates 26 and thus the squeeze plates 24 about the pins 25 in opposite directions indicated by arrows in FIG. 7. Thus, the bottom of the squeeze head 23 is opened to release the batch of sand 33' downwardly into the flasks 7 and 13. Thereafter, the piston rod 29 of the cylinder 28 is lifted to rapidly rotate or return the squeeze plates 24 to their initial or closed positions shown in FIG. 6. The squeeze cylinders 20 are again actuated to downwardly move the rods 21 so that the squeeze head 23 is again moved downwardly to urge the squeeze plates 24 against the sand 33' in the flasks 7 and 13 whereby the sand is squeezed. In the case where a jolt device is installed in the molding table 3, the squeezing operation described may be combined with a jolt operation to advantageously increase the sand-squeezing and pressing effect.

Figure 8:
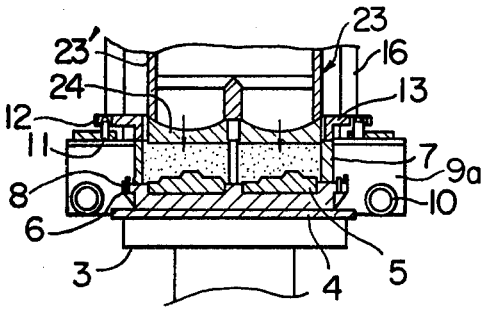
FIG. 8 is a partly sectional fragmentary front view of the molding machine showing the squeezing plates when a sand squeezing operation is substantially finished.

After the completion of the squeezing (and jolt), the squeeze and rapping cylinders 20 and 19 are actuated to lift their piston rods 21 and 19' so that the molding flask 7 with a mold thus formed therein, the sand-heaping flask 13 and the squeeze head 23 are respectively lifted from the positions shown in FIG. 8 through the positions shown in FIGS. 5, 4 and 3, respectively, to the uppermost positions shown in FIG. 1 whereby a rapping operation is carried out. It will be noted that FIG. 3 shows an empty molding flask 7 and the associated machine components in positions in which the molding flask 7 has been guided and set at a predetermined molding position. FIG. 3 does not show a mold formed in the flask 7, but it will be appreciated that the positions of the flask 7 and the associated machine components shown in FIG. 3 are substantially identical with those in which a rapping operation is going to be started. The molding flask 7 with a sand mold thus formed therein is then removed from the molding machine and conveyed to another place for the next step of process and a next empty molding flask is fed into the machine by a conventional flask conveyor (not shown) and placed in position while a next batch of sand is supplied from the conveyor belt 31 through the chute 34 into the squeeze head 23 to complete a cycle of molding operation. The steps of operation described above will be cyclically repeated to form molds.

Figure 9:
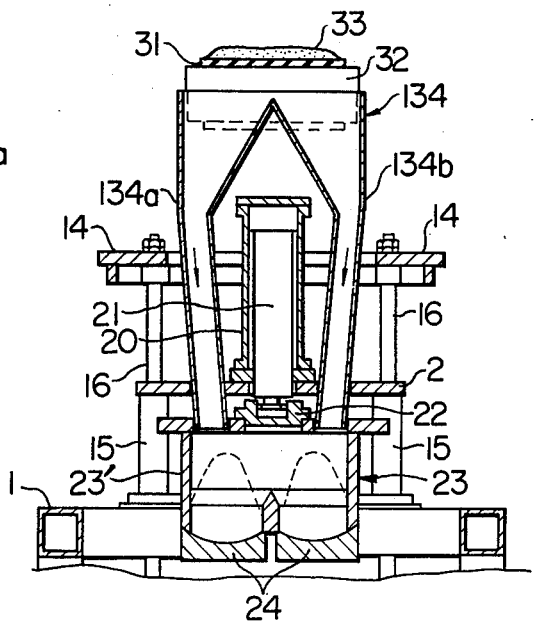
FIG. 9 is a partly sectional fragmentary front elevation of a second embodiment of the molding machine according to the invention.

A second embodiment of the invention is shown in FIG. 9 in which parts similar to those of the first embodiment described with reference to FIGS. 1 to 8 are designated by similar reference numerals. The difference between the first and second embodiments is that the second embodiment employs a modified sand chute 134 which is divided into two laterally spaced branches 134*a* and 134*b* defining therebetween a space in which the squeeze cylinders 20 (only one of which is shown) are disposed. Sand 33 is fed by the conveyor belt 31 through the branches 134*a* and 134*b* of the chute 134 into a single squeeze head 23 similar to that of the first embodiment.

The molding machine according to the present invention provides the following advantages:

(1) Because the squeeze head 23 of the molding machine of the present invention also acts as a sand hopper, the machine does not need such means for horizontally reciprocally moving a squeeze head or device and a sand hopper as were needed by the prior art machine;

(2) The fact that the reciprocally moving means do not exist in the machine of the invention makes it possible to locate the sand-heaping flask 13 above a molding flask on the roller frames 9*a* and 9*b* and to dispose the sand hopper and squeeze head above the molding flask, with a resultant advantage that sand is not scattered during a sand charging operation but can be uniformly and flatly introduced into the molding flask;

(3) The feature that the movable machine parts, such as the rapping device and squeeze device, are disposed in the upper machine section minimizes the scattering of sand onto the movable machine parts to reduce the wear of the movable parts and thus reduce machine trouble and increase the operative life of the machine;

(4) The reduction in the wear of the movable machine parts is effective to prevent the rapping accuracy from being lowered and thus to contribute to the production of cast articles of high quality as well as to make it possible to minimize the taper of a pattern and improve the reproducibility of the pattern on molds and particularly at the corner portions thereof for thereby assuring the production of cast articles with high dimensional precision;

(5) The placement of the movable machine parts such as the squeeze device and the rapping device in the upper machine section facilitates easy maintenance of the machine;

(6) The fact that the movable machine parts are not disposed in the lower machine section makes it possible to decrease the depth of a machine installation pit and thus to contributes to the reduction of expenses involved in the preparation of the foundation or footing for the machine;

(7) As compared with the prior art molding machine of the type in which squeeze, rapping and jolt devices were gathered together into a unitary structure, a jolt device if installed in the molding machine of the invention can be disposed independently of the squeeze and rapping devices and a measure can more easily be taken against the noise produced by the jolt; and (8) The fact that the squeeze head 23 is light-weighted and also acts as a sand hopper which is movable downwardly toward the molding table even during a flask-guiding and positioning operation eliminates such a time-consuming horizontal reciprocal movement of a heavy-weighted squeeze head as was required by the prior art machine, with a resultant advantage that the time required for each molding operation is shortened.

What is claimed is:

1. In an improved molding machine including upper and lower sections, a molding table disposed in said lower machine section and adapted to support thereon at least one pattern around which sand is formed into a mold, a squeeze means including at least one fluid-actuated squeeze cylinder disposed at a level above said molding table and squeeze plate means operatively associated with said squeeze cylinder so that said squeeze plate means is substantially vertically moved into and out of squeezing engagement with a sand mold around said pattern, and rapping means disposed in said upper machine section, the improvement which comprises:

an open-topped hollow tubular member operatively connected to said squeeze cylinder;

said squeeze plate means being mounted on said tubular member for pivotal movement between open and closed positions to open and close the bottom of said tubular member;

said tubular member and said squeeze plate means when in closed position cooperating together to define a sand retaining space and to form a squeeze head operable by said squeeze cylinder.

2. The molding machine according to claim 1, further including a sand-heaping flask, and wherein said rapping means include a roller frame means carrying rows of rollers for supporting a molding flask thereon, means for operating said sand-heaping flask on said roller frame means for relative movement with respect to each other in substantially vertical direction and means for guiding said relative movement, said guiding means including guide pins mounted on one of said roller frame means and said sand-heaping flask and guide holes formed in the other.

3. The molding machine according to claim 1, wherein said sand retaining space is of a volume substantially equal to the amount of sand required to form a mold.

4. The molding machine according to claim 1, wherein said squeeze plate means comprise a pair of squeeze plates pivotable in opposite directions.

5. The molding machine according to claim 4, further including means for actuating said pivotable squeeze plates, said actuating means including a second fluid-actuated cylinder having a piston rod, a rack member connected to said piston rod, pinion members fixed with respect to said squeeze plates and being in meshing engagement with said pinion member, respectively, whereby said squeeze plates are pivotally moved by said second cylinder.

6. The molding machine according to claim 1, further including a substantially vertical sand-feeding chute means, and wherein said tubular member of said squeeze head is disposed in telescopic relationship with the bottom end of said sand-feeding chute means.

7. The molding machine according to claim 6, wherein said sand-feeding chute means comprises a pair of laterally spaced branches defining a space therebetween, and wherein said squeeze cylinder is disposed in said space.

* * * * *